United States Patent [19]

Flemming et al.

[11] Patent Number: 4,787,438

[45] **Date of Patent: * Nov. 29, 1988**

[54] METHOD AND APPARATUS FOR CONTINUOUSLY CASTING METAL

[75] Inventors: Günter Flemming; Hans Streubel; Manfred Kolakowski, all of Erkrath, Fed. Rep. of Germany

[73] Assignee: SMS Schloemann-Siemag, A.G., Düsseldorf, Fed. Rep. of Germany

[ * ] Notice: The portion of the term of this patent subsequent to Mar. 8, 2005 has been disclaimed.

[21] Appl. No.: 14,654

[22] Filed: Feb. 13, 1987

[30] Foreign Application Priority Data

Feb. 27, 1986 [DE] Fed. Rep. of Germany ..... 3606290

[51] Int. Cl.[4] ..... B22D 11/18; B22D 11/20

[52] U.S. Cl. ..... 164/453; 164/454; 164/483; 164/449

[58] Field of Search ..... 164/452, 453, 454, 449, 164/450, 413, 483, 472, 459, 418, 150, 154

[56] References Cited

U.S. PATENT DOCUMENTS

| | | | |
|---|---|---|---|
| 3,204,460 | 9/1965 | Milnes | 164/449 X |
| 4,383,571 | 5/1983 | Frantz et al. | 164/426 |
| 4,729,420 | 3/1988 | Flemming et al. | 164/453 |

FOREIGN PATENT DOCUMENTS

| | | | |
|---|---|---|---|
| 3400220 | 7/1985 | Fed. Rep. of Germany | 164/418 |
| 55-141366 | 11/1980 | Japan | 164/453 |
| 57-159251 | 11/1980 | Japan | 164/449 |
| 56-151147 | 11/1981 | Japan | 164/150 |
| 57-32863 | 2/1982 | Japan | 164/150 |
| 58-84652 | 5/1983 | Japan | 164/453 |

*Primary Examiner*—Kuang Y. Lin

*Attorney, Agent, or Firm*—Russell & Tucker

[57] ABSTRACT

Apparatus and processes for use therewith are provided for the start-up of the continuous casting of strip metal, preferably steel, in which liquid metal is poured into a flared type continuous casting strip-shaped mold equipped with detector means for monitoring the instantaneous surface level of the liquid metal bath formed in the flared zone of the mold, and sensor means for sensing the presence of liquid in the core of the cast strip downstream of the mold, and means are further provided responsive to said detectors and sensor for controlling both the rate of pouring the liquid metal, and the start-up and rate of withdrawal of the cast strip to ensure the continuous presence of a liquid metal core in said cast strip downstream of said mold, for signalling when the distribution ports of the pouring tube become submerged, and for thereafter during casting maintaining a predetermined optimum operating surface level of said metal bath.

13 Claims, 3 Drawing Sheets

1
2
3
4
5
6
7
8
9
10
11
12
13
14
15
16
17
18
19
20
21

METHOD AND APPARATUS FOR CONTINUOUSLY CASTING METAL

FIELD OF THE INVENTION

This invention relates to the continuous casting of strip metal, especially strip steel. More particularly it relates to a process and apparatus for the control of the interrelationships during start-up between the rate of pouring molten metal into the flared zone in the inlet end of a continuous casting mold, the cooling rate of the metal due to the extraction of heat through the internally water-cooled walls of the mold, and the speed with which the cast strip is withdrawn from the parallel walled (strip shape determining) zone in the exit end of the mold. Still more particularly, the invention relates to controlling the above relationships during start-up together with timing the application of the anti-oxidation and lubricating cover over the molten metal bath (which will be referred to hereinafter as simply the "metal bath") in relation to the effective duration of the prelubrication within the mold cavity so that the anti-oxidation cover which also functions as a lubricant becomes effective before the prelubrication becomes ineffective.

BACKGROUND OF THE INVENTION

It has been conventional to pour molten metal into continuous casting molds for the production of steel slab, while maintaining the conditions of pouring, cooling and slab withdrawal so that the still liquid metal core within the embryonic casting, extends down into and below (or downstream of) the parallel walled zone of the mold (e.g. DE PS No. 887,990).

In such prior art methods, however, it has been difficult, especially at the start of pouring, to be sure that the liquid metal core within the casting always extends downwardly below the neck between the tapered, pouring zone of the mold into the zone where the walls of the mold are parallel. Unless this liquid core always extends downstream of the tapered zone, either localized bridges or an incompressible block forms at the neck, at which point the casting cannot be pulled through the mold, and the start-up of the casting operation has to be aborted. The risk of this happening arises from the fact that, when pouring starts, the incoming metal congeals rapidly on the cold walls of the mold and on the cold head of the dummy strip which is used to plug off the downstream end of the mold cavity and to lead the strip from the mold subsequently. In addition, at the start of pouring, the inrushing molten metal, which comes in through a pouring tube (sometimes referred to in the industry as a "submerged entry tube" even though it is not submerged at the start), if not properly controlled, will splash up along the sides of the mold where it may congeal and thereafter stick to the mold wall or otherwise interfer with the proper formation of the casting shell (i.e. the congealed superficial layer within the casting adjacent to the mold wall), and thereby eventually lead to surface defects or ruptures of the skin (break-out) as the casting proceeds further downstream. Another problem is that the antioxidation cover for the surface of the metal bath, which is required for both lubrication between the casting and the mold wall and for protection against oxidation of the liquid metal at the exposed surface of the melt at the top of the metal bath, can be applied to the surface of the bath only after the distribution ports of the pouring tube have become fully immersed in the melt. This is because the anti-oxidation and lubricating covering material (which is usually particulate), must not be allowed to mix with the casting metal, which would happen if the covering material were applied before the distribution ports of the pouring tube were immersed. It has been found that in these prior art devices and processes, the prelubrication within the mold tends to lose its effectiveness before the lubricating effect of the covering material can become operative thereby resulting in unacceptably high and uneven friction between the embryonic casting and the mold walls. If these aspects of the initial phase of pouring are not carefully controlled, either the casting has to be aborted, or a substantial length of the cast material at the start will be rendered unusable by virtue of the formation of hot spots, cold shuts, laps, or other surface defects. Accordingly, with the conventional apparatus and processes, at the start of pouring an undue burden is placed on the operating personnel rapidly to achieve maximum static head of the melt and the optimum balance between pouring rate, and withdrawal rate while at the same time covering the melt soon enough to avoid excessive friction between the congealed surface of the casting and the mold walls. This undue burden leads in turn to operational errors.

It is, therefore, an object of this invention to provide both apparatus and methods for the start-up of pouring metal, preferably steel, into the flared inlet end of continuous casting mold for the production of strip metal which method substantially relieves the operating personnel of these burdens by automatically shortening the time to reach optimum conditions and reducing the risk of the metal sticking to the mold wall. Another object is to provide apparatus and methods whereby the anti-oxidation and lubricating covering for the surface of the metal bath can be applied and become effective before of the prelubrication in the mold becomes inefficient..

BRIEF DESCRIPTION OF THE INVENTION

These and other objects of the invention are achieved in an embodiment selected for purposes of illustration in which the molten metal is poured into a tapered pouring zone of a narrow, slotted (strip shaped) continuous casting mold the distal end of which comprises a strip shaping zone having parallel side walls. The instantaneous surface level of the metal bath in the mold is continuously monitored by temperature detectors embedded in the walls of the mold. According to the preferred start-up procedure the retraction of the dummy strip is commenced shortly after the distal shaping zone has filled and before the surface of the metal bath immerses the ports of the pouring tube. Also the pouring rate of the metal $v_B$ is regulated so that the surface level of the metal bath increases from the start of pouring until it reaches the desired level for casting and the speed of withdrawing the cast strip $v_{Bm}$ is regulated to maintain the tapered end of the liquid core within the cast strip, at all times not only on the downstream side of the lower neck of the tapered pouring zone but also on the downstream side of the distal shaping parallel walled zone of the mold.

It is a feature of the invention that the surface level of the metal bath is determined by measuring the temperature of the walls by means of temperature measuring detectors embedded at a multiplicity of points along the walls of the mold. Another feature is that the location of the end of the liquid core or the cast strip is determined by measuring the fluid pressure within the cast strip by force measuring sensors associated with rollers in contact with the cast strip on its broad sides immediately downstream of the exit end of the mold. In one embodiment, the location of the end of the liquid core is detected by means of ultrasonic sensors.

It is a feature of one embodiment of the invention that means are provided to move the pouring tube relative to the mold and that at the start of pouring the pouring tube is positioned so that its exit ports are as close to the neck of the flared zone as possible. This permits the distribution ports to be immersed in the melt as soon as possible after the start of pouring. This reduces the delay time between the start of pouring and the application of the anti-oxidation and lubricating covering to insure that the lubricating effect of the covering material will become operational before the prelubrication in the mold becomes inefficient. Once the distribution ports are covered, the pouring tube can be raised away from the neck and thereby reduce the risk of turbulence in the metal near the neck. Also, during pouring, the mold is oscillated vertically. This has the effect of promoting the passage of the anti-oxidation and lubrication material down the sides of the mold between the mold walls and the cast strip so as to maintain low friction between the congealed skin of the cast strip and the walls of the mold.

A feature of the invention is that the output of the temperature detectors within the mold walls indicates the instantaneous level of the surface of the metal bath and the force sensors located downstream of the distal end of the mold indicate the presence downstream of the mold of the end of the liquid core of the cast strip, and that these data are continuously transmitted to a microprocessor which in turn regulates the respective rates of withdrawal of the cast strip and the pouring rate of the molten metal to optimise the start-up sequence. In addition, the microprocessor determines the optimum moment for the application of the casting flux to the surface of the metal bath in relation to the level of the surface of the metal bath and the position of the distribution ports of the pouring tube so that the covering material is applied as soon as the distribution ports are immersed and thereby to minimize the time between the start of pouring and when the lubricating effect of the covering material becomes operational.

It is a feature of the invention that performing these procedures by digital processing means substantially relieves the burden on the operating personnel, and reduces operating errors as well as increasing operating safety. They also promote the formation of a homogeneous and generally uniformly progressively increasing thickness of congealed skin which avoids the heterogeneous formations and resistance causing bridges experienced with the prior art methods. Using these procedures a cast strip of 50 mm thick strip steel is feasible, the withdrawal of the dummy strip is started between about 15 and 25 seconds after pouring begins, and the minimum withdrawal rate is 1.1 m/min.

BRIEF DESCRIPTION OF THE DRAWINGS

Preferred embodiments of the invention selected for purposes of illustration only are shown in the accompanying drawings in which.

DETAILED DESCRIPTION OF THE INVENTION

Figures 1, 2:
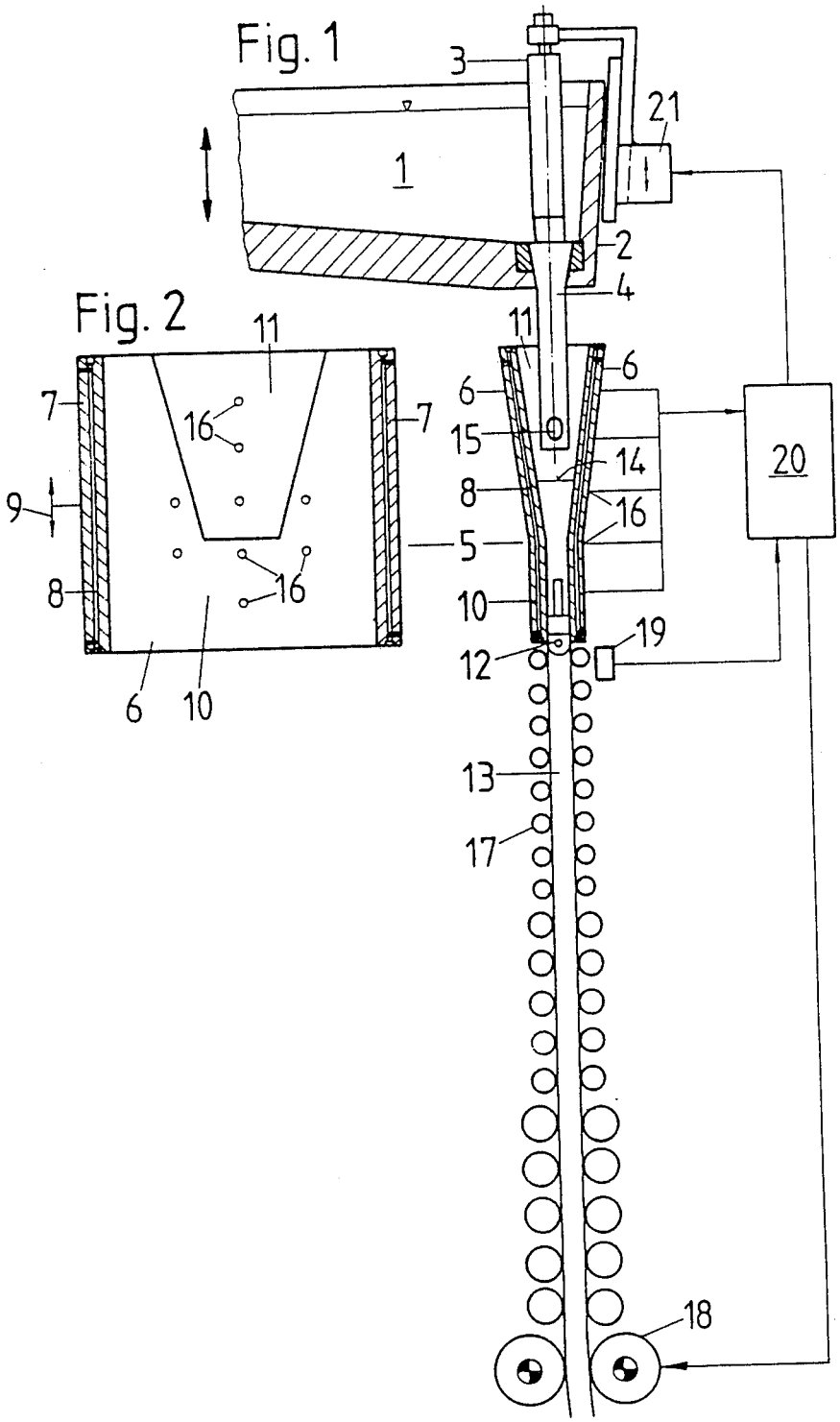
FIG. 1 is a diagramatical cross-sectional view of the continuous cast strip equipment of the invention showing a cross-section of the mold in elevation from its narrow end.
FIG. 2 is a sectional view of the mold in side elevation.

The illustrative embodiment of the invention herein shown comprises a steel melt 1 in a tundish 2 arranged to supply molten steel to a pouring tube 4 at a pouring rate which is regulated by a valve 3 the vertical position of which is regulated by servo 21 to adjust the size of the orifice leading from the tundish 2 into the pouring tube 4 and hence the flow rate of the metal. The pouring tube 4 supplies liquid steel to a continuous casting mold indicated generally at 5 the cavity of which defines a narrow, strip shaped slot having broad side walls 6 and narrow end walls 7 each of which is provided with internal cooling ducts 8. A conventional oscillating mechanism (not shown) is provided to oscillate the mold vertically as indicated by the arrows 9. The upper part of the mold is flared or tapered in a pouring zone 11 necking down to the desired size and shape of the strip to a distal zone 10 in which the respective side and end walls of the mold are parallel.

The liquid steel flows through the pouring tube 4, laterally out through distribution ports 15 in the lower end of pouring tube 4, into the mold 5 and thence to head 12 of a dummy strip 13 which plug the distal zone 10 at the start of pouring. The surface level 14 of the metal bath rises as the mold cavity starts filling up, and once the level 14 covers the distribution ports 15, an anti-oxidation and lubrication material commonly called a "flux" (not shown) is applied to the surface of the metal bath. The instantaneous level 14 of the surface of the metal bath is continuously monitored by means of a multiplicity of temperature sensing detectors 16 located at a multiplicity of places in both vertical and horizontal array in the broad side walls 6 of the mold both in the pouring zone 11 and in the distal zone 10.

At the start of pouring, the dummy strip 13 is positioned in a strip guide comprising an extended series of supporting idler rollers 17 downstream of the mold, terminating with a pair of driven withdrawal (pinch) rolls 18 which initially withdraw the dummy strip 13 and then the cast strip.

Figure 3A:
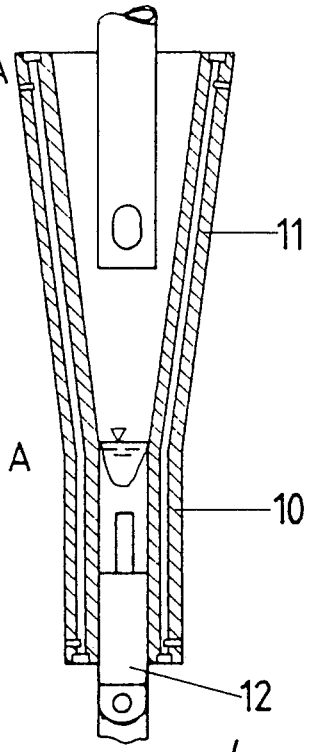
FIGS. 3A–3D is a composite view in cross section of the mold in end elevation showing progressively four different stages of the initiation of the pouring operation.
Figure 3B:
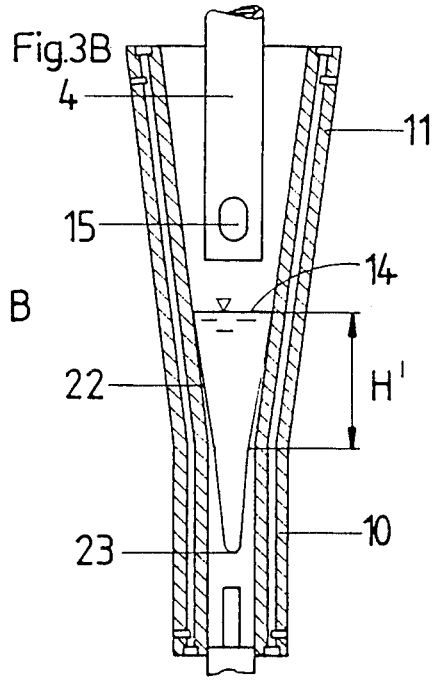
Figure 3C:
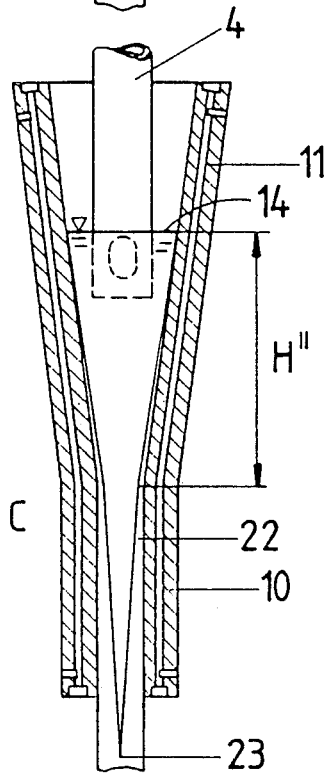
Figure 3D:
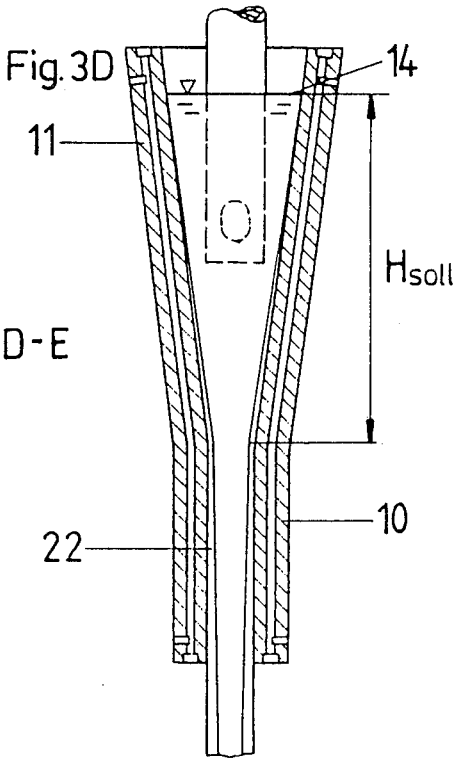

Before the start of casting, a prelubrication material is applied to the surfaces of the mold cavity. When pouring starts, the sequence of the pouring of the liquid steel and the formation of the congealed skin 22 of the cast strip within the mold 5 is illustrated progressively in FIG. 3, phases A, B, C, D and E, and in FIG. 4 which sets forth (diagramatically, without exact graphic positioning of the lines between the two views), the time-rate relationships between the pouring and the withdrawal. Immediately upon the start of pouring the liquid metal runs down into contact with the head 12 of the dummy strip 13, where it congeals around the projections on the head 12, and upwardly along the sides of the mold where the metal contacts the relatively cold mold, while the surface level 14 of the metal bath builds up. Once the level 14 has risen above the neck between the distal zone 10, the drive rollers 18 are actuated so as to start retracting the dummy strip and both pouring and retraction are continued while the metal bath builds up to level H' in FIG. 3B. The level of the bath surface 14 is detected by heat detectors 16 embedded in the broad side walls of the mold, the output of which is fed to a microprocessor 20 which generates command signals for the actuation of motors (not shown) for driving the pinch rollers 18 and the control of the withdrawal rate of of the cast strip. As the cast strip is withdrawn it passes from the distal end of the mold through a pair of idler rollers in contact with the sides of the cast strip the mountings of which are provided with force measuring sensor 19. If the tip end 23 of the liquid core within the congealed skin of the cast strip does not extend downstream of the mold 5 and to rolls equipped with the force measuring sensor 19, little or no force will be measured. This latter condition exists at the start of the withdrawal as can be seen in FIG. 3B. However, when the cast strip is withdrawn further and at a fast enough rate to bring the tip end 23 of the liquid core of the cast strip below the point of the force measuring sensor 19, the fluid pressure within the core will cause the side walls of the cast strip to attempt to bulge slightly, and a force will be exerted against the rolls and detected by sensor 19. The output of force measuring sensor 19 is also fed to the microprocessor which, in turn controls the drive rate of drive rollers 18 so as to increase that rate at least to a point at which the force measuring sensor indicates the presence of the liquid core beyond the downstream end of the mold 5 but not so fast as to prevent the continued build-up of the surface level of the metal bath in the mold.

Figure 4A:
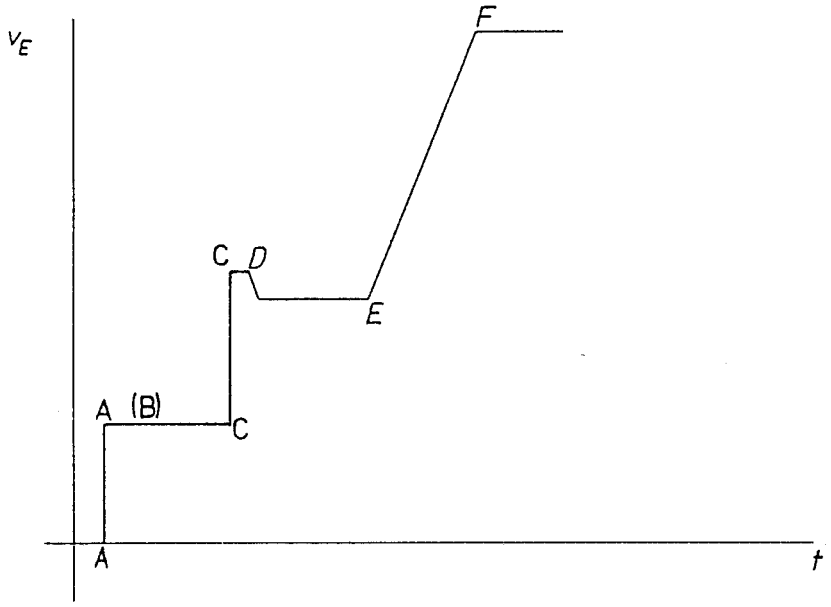
FIGS. 4A and 4B are two graphs showing the time-rate relationships between the pouring rate and the withdrawal rate.
Figure 4B:
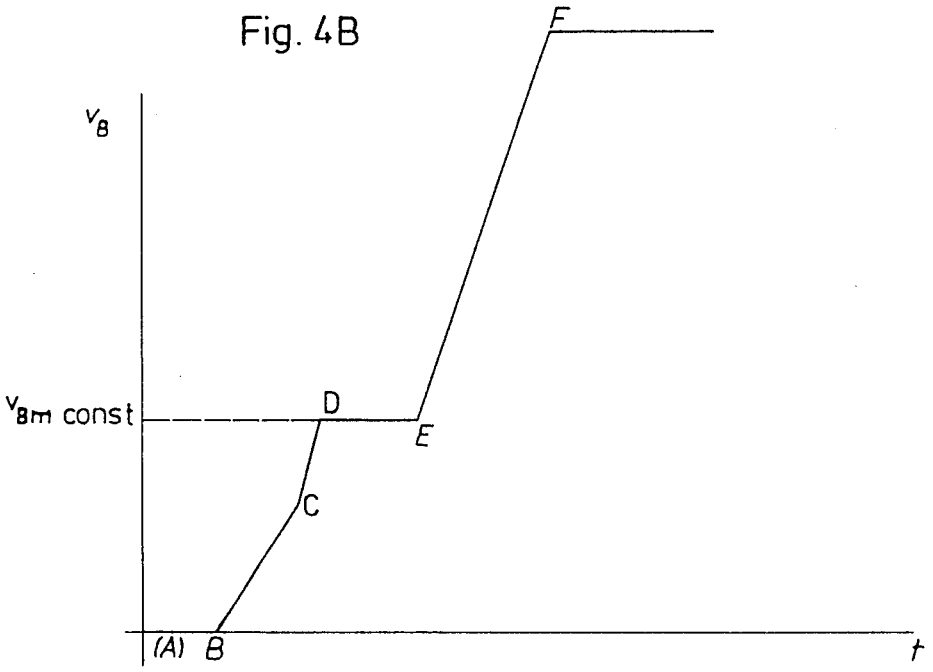

As the pouring is continued and the surface level 14 of the metal bath rises, it rises to level H'' (see FIG. 3C), where it covers the distribution ports 15 of the pouring tube 4. This level H'' is also detected by the temperature detectors 19, the signals of which are processed in the microprocessor which in response thereto isues command signals for the application of the anti-oxidation and lubricating material to the surface of the metal bath. At this point the rates of both pouring and withdrawing are increased as indicated in FIG. 4, (it being assumed, however, that the two views are not exactly to scale and that the pouring rate exceeds the withdrawing rate so that the surace level 14 will build up) until the surface level 14 of the metal bath has reached its full operating height $H_{soll}$. During the period of time between points B–D the minimum withdrawl speed $v_{Bm}$ is a function of the instantaneous surface level 14 of the metal bath in the tapered zone 11 of the mold. After a stabilization period D–E, $v_E$ and $v_B$ are accelerated to F (but with $v_E$ being greater than $v_B$ until the maximum level has been reached) by the microprocessor by comparison between the actual surface level 14 and desired level $H_{soll}$.

Relative motion between the mold and the pouring tube 4 is attained by arranging the pouring tube to move vertically. The advantage of this embodiment is that it shortens the time between the start of pouring and the application of the deoxidation and lubrication cover and thereby reduces the risk of the prelubrication becoming inefficient before the effect of the lubrication of the cover can be felt. In addition, by removing the end of the pouring tube well above the lower neck of the flared zone 11, the risk of turbulence in the metal close to the neck is avoided.

Having now described illustrative embodiments of our invention, various modifications thereof will be apparent to those skilled in the art. For example the level of the surface of the metal bath may be detected by electrical resistance thermal detectors, or even by optical means. In addition the location of the tip 23 of the liquid core of the cast strip may also be sensed at a multiplicity of additional sensors at further locations downstream in order to assure that the molten tip does not extend as far as the pinch roll 18. It also can be sensed by ultrasonic, or magnetic means. Accordingly it is not our intention to confine the invention to the precise form shown in the accompanying drawings but rather to limit it only in terms of the appended claims.

We claim:

1. A method for the start-up of continuously cast strip metal comprising the steps of:

positioning a dummy strip having a connection head in a narrow slotted mold having a flared inlet pouring zone necking down to a distal zone in which the walls of the mold are parallel and spaced apart by substantially the desired cross-sectional shape and dimensions of the strip being cast, pouring liquid metal through a pouring tube having an orifice, into the flared zone of said mold to form a metal bath and controlling the rate of pouring, continuously detecting and monitoring the surface level of said bath, withdrawing said dummy strip after the level of said bath rises above the neck between said flared and distal zones, and controlling the rate of withdrawal, maintaining the relative pouring and withdrawal rates so that the surface level of said bath continues to rise, continuously monitoring said cast strip on the downstream side of said mold with a fluid presence sensor to indicate the presence of liquid in the core of said cast strip, and increasing the withdrawal rate of the cast strip from the mold until said fluid sensor indicates the presence of liquid metal in the core of said cast strip at a point downstream of the distal end of said mold.

2. The method defined in claim 1 further characterized by:

detecting when said level rises to a point at which the orifices of said pouring tube are immersed, and applying an anti-oxidation and lubrication cover to said surface in response to the detection of the immersion of said orifices.

3. The method defined in claim 2 further characterized by:

increasing both the pouring rate and the withdrawal rate with the latter remaining less so that the surface level of said bath continues to rise, until said surface level reaches a level $H_{soll}$, a predetermined optimum level, and then regulating both rates so as to maintain the surface level of the bath at $H_{soll}$.

4. The method defined in claim 3 further characterized by:

oscillating the mold vertically during pouring.

5. The method defined in claim 4 further characterized by:

at the start of pouring moving the pouring tube vertically relative to the mold between a proximal turbulence avoiding position and a distal position, starting pouring with the orifice of the tube in the distal position, and after the orifice is immersed, moving the tube to the proximal position at a rate which is at or slower than the rate of rise of the surface of the bath.

6. The method defined in claim 1 further characterized by:

the metal being steel.

7. The method defined in claim 1 further characterized by:

said metal being steel.

8. Apparatus for continuously casting metal strip comprising:

a narrow slotted mold having inlet and exit ends, a flared pouring zone adjacent to the inlet end necking down to a distal zone having parallel sided stripforming walls adjacent to the exit end, a dummy strip having a connecting head, for starting casting strip, means for positioning said dummy strip in the distal end of said mold, means for withdrawing said dummy strip from said mold through a series of support idlers, means extending into said pouring zone near to but clear above the neck between the distal and pouring zones, said means having an orifice for pouring liquid metal into said mold to form a metal bath and for filling said mold around said connection head up into the distal and pouring zones so as to immerse said orifice, means for detecting and monitoring the instantaneous surface level of said bath and for generating signals responsive thereto so as to indicate the instantaneous surface level of said bath from within said distal zone to the top of said pouring zone, a first means responsive to said detecting means for actuating said withdrawing means to start the withdrawal of said dummy strip after the start of pouring but only after the surface level of said bath rises higher than the neck between said distal and pouring zones, a second means for regulating the respective withdrawing and pouring rates so that the surface level of the bath continues to rise above said orifice to a predetermined operating level after the commencement of said withdrawal, a third means responsive to said detecting means for thereafter further controlling the respective withdrawing and pouring rates to reach a predetermined casting speed while maintaining the bath surface substantially at said operating level, means downstream of the exit end of said mold for sensing the presence of liquid metal in the core of said cast strip, and a fourth means responsive to said sensing means for further increasing the withdrawal rate of said cast strip to a speed at which the tip end of the liquid core of said cast strip is at least downstream of said sensor.

9. The apparatus defined in claim 8 further characterized by:

means responsive to said surface level detector for signalling when said orifice is immersed by said bath, and means for applying an anti-oxidation cover to the bath once the immersion of said orifice has been detected.

10. The apparatus defined in claim 9 further characterized by:

means responsive to said surface level detector for regulating the pouring rate in relation to the withdrawal rate so that the surface level continues to rise until it reaches a predetermined level $H_{soll}$, and means for adjusting the pouring and withdrawal rates so that the surface level remains thereafter at $H_{soll}$.

11. The apparatus defined in claim 10 further characterized by:

said detecting means comprising electrical temperature detection means embedded in the mold walls in both zones.

12. The apparatus defined in claim 10 further characterized by:

said liquid presence sensor comprising means for measuring the fluid force exerted by liquid metal within the core of said cast strip outwardly against the congealed skin of said cast strip while said cast strip is still in the embryonic state.

13. The apparatus defined in claim 12 further characterized by:

ultrasonic means for sensing the presence of liquid metal in the core of said cast strip.

* * * * *